US005678921A

United States Patent [19]

Kish et al.

[11] Patent Number: 5,678,921

[45] Date of Patent: Oct. 21, 1997

[54] FLASHLIGHT

[75] Inventors: Paul A. Kish, Wilkes-Barre, Pa.; Graham E. Leavy, Montville, N.J.; Randy S. Cramer, Lebanon, Pa.

[73] Assignee: Bright Star Industries, Inc., Wilkes-Barre, Pa.

[21] Appl. No.: 354,098

[22] Filed: Dec. 6, 1994

[51] Int. Cl.[6] ..... F21L 7/00

[52] U.S. Cl. ..... 362/205; 362/188; 362/202

[58] Field of Search ..... 362/187, 188, 362/197, 202, 203, 205, 208, 348

[56] References Cited

U.S. PATENT DOCUMENTS

| | | | |
|---|---|---|---|
| 1,253,813 | 1/1918 | Gray . | |
| 1,260,387 | 3/1918 | Johanson . | |
| 1,296,404 | 3/1919 | Koretzky . | |
| 1,368,278 | 2/1921 | Miller . | |
| 1,394,319 | 10/1921 | McNeal . | |
| 1,433,570 | 10/1922 | Stimson . | |
| 1,443,089 | 1/1923 | Pepper . | |
| 2,097,222 | 10/1937 | Tomkins et al. | 240/10.66 |
| 2,134,856 | 11/1938 | Burgess | 240/10.68 |
| 2,229,486 | 1/1941 | Barash et al. | 240/10.66 |
| 2,229,495 | 1/1941 | Desimone | 240/10.6 |
| 2,235,714 | 3/1941 | Lennan | 240/10.66 |
| 2,268,878 | 1/1942 | Kopp | 240/10.6 |
| 2,271,672 | 2/1942 | Yen | 240/10.66 |
| 2,309,402 | 1/1943 | Korngold | 200/60 |
| 2,312,670 | 3/1943 | Olds | 240/10.6 |
| 2,355,247 | 8/1944 | Slocum | 240/10.68 |
| 2,477,516 | 7/1949 | Haas | 200/60 |
| 2,493,205 | 1/1950 | Muldoor | 362/197 |
| 2,500,364 | 3/1950 | Kopp | 240/10.66 |
| 2,502,600 | 4/1950 | Spender | 200/60 |
| 2,530,505 | 11/1950 | Brill | 240/10.66 |
| 2,690,503 | 9/1954 | Garland | 240/10.66 |
| 2,716,182 | 8/1955 | Carter | 240/10.66 |
| 2,804,541 | 8/1957 | Schotz | 362/205 |
| 2,855,499 | 10/1958 | Lewis | 240/10.6 |
| 2,913,570 | 11/1959 | Gough et al. | 240/3 |
| 3,017,502 | 1/1962 | Dent | 240/10.68 |
| 3,162,376 | 12/1964 | Furuya | 240/10.66 |
| 3,175,080 | 3/1965 | Moore | 240/10.65 |
| 3,196,268 | 7/1965 | Mack | 362/188 |
| 3,334,200 | 8/1967 | Moore et al. | 200/60 |
| 3,511,983 | 5/1970 | Dorman | 240/41.15 |
| 3,662,165 | 5/1972 | Osteen et al. | 240/103 R |
| 3,794,825 | 2/1974 | Krupansky | 240/10.63 |
| 4,021,659 | 5/1977 | Wiley | 240/41.36 |
| 4,025,743 | 5/1977 | Oswald | 200/60 |
| 4,156,271 | 5/1979 | Vercellotti | 362/202 |
| 4,286,311 | 8/1981 | Maglica | 362/205 |
| 4,325,107 | 4/1982 | MacLeod | 362/183 |
| 4,357,648 | 11/1982 | Nelson | 362/183 |
| 4,527,223 | 7/1985 | Maglica | 362/187 |
| 4,531,178 | 7/1985 | Uke | 362/158 |
| 4,545,000 | 10/1985 | Fraley et al. | 362/304 |
| 4,816,972 | 3/1989 | Myhres | 362/202 |
| 4,875,146 | 10/1989 | Drane | 362/202 |

(List continued on next page.)

*Primary Examiner*—Y My Quach
*Attorney, Agent, or Firm*—Nies, Kurz, Bergert & Tamburro

[57] ABSTRACT

A flashlight having a reinforced tubular plastic casing including a battery compartment and a bulb compartment separated by a transverse wall integrally molded with the casing. A bulb is retained in a socket integrally molded with the wall by a bushing which may be quickly connected and disconnected from the socket, the bulb and the bushing being resiliently axially moveable with respect to the socket and the transverse wall to prevent breakage of the bulb due to shock or impact. A novel reflector is axially moveable with respect to the bulb to afford adjustable focussing of the light emitted from the bulb. The reflective surface of the reflector combines a facetted parabolic surface on the outer portion of the reflector with a smooth spherical surface at the base of the reflector to optimize the amount of light collected from the light bulb and focused in the beam. A novel three-position switch assembly includes a one piece plastic actuator having an integrally molded pivotable pushbutton lever which may be actuated to flash the lamp on and off. The actuator is quickly and easily snapped into place in a switch housing to facilitate assembly.

35 Claims, 5 Drawing Sheets

U.S. PATENT DOCUMENTS

| | | | |
|---|---|---|---|
| 4,914,555 | 4/1990 | Gammache | 362/183 |
| 4,916,588 | 4/1990 | Chu | 362/203 |
| 4,951,183 | 8/1990 | Wang | 362/187 |
| 4,994,948 | 2/1991 | Cooch | 362/346 |
| 5,021,934 | 6/1991 | Hou | 362/187 |
| 5,121,308 | 6/1992 | Maglica et al. | 362/187 |
| 5,124,894 | 6/1992 | Shiau | 362/187 |
| 5,126,927 | 6/1992 | Reeves et al. | 362/187 |
| 5,138,537 | 8/1992 | Wang | 362/187 |
| 5,165,782 | 11/1992 | Maglica et al. | 362/208 |
| 5,167,447 | 12/1992 | Gonzales | 362/202 |
| 5,207,502 | 5/1993 | Maglica | 362/158 |
| 5,213,408 | 5/1993 | Shiau | 362/187 |
| 5,272,408 | 12/1993 | Levin et al. | 313/113 |
| 5,272,606 | 12/1993 | Blaney | 362/157 |
| 5,315,494 | 5/1994 | Maglica | 362/207 |

Fig.8
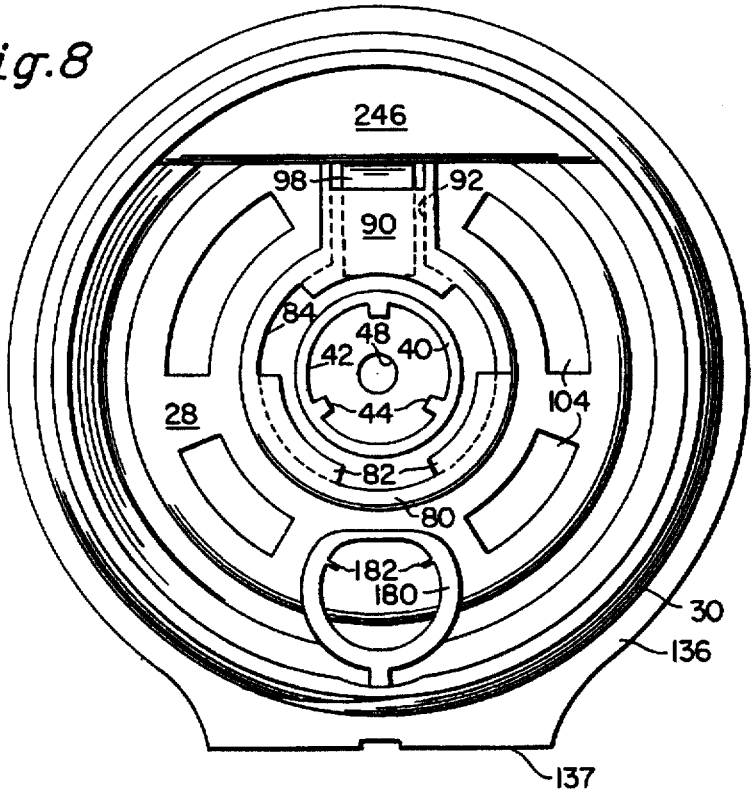
Fig.9
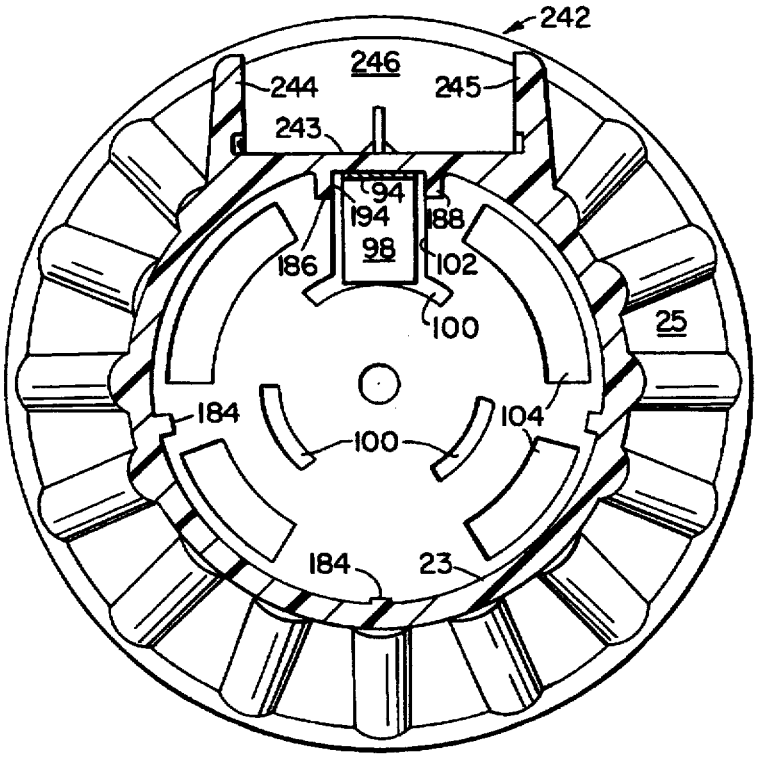
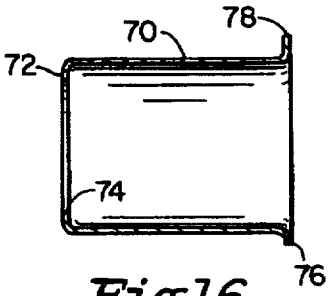
Fig.16
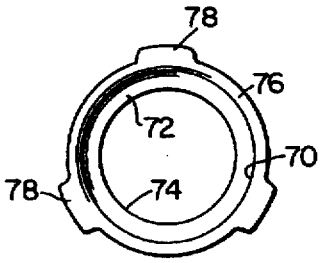
Fig.17

FLASHLIGHT

BACKGROUND OF THE INVENTION

This invention relates generally to flashlights, and more particularly to a novel flashlight having an all plastic exterior construction suitable for heavy-duty use, easy to assemble, and reasonable in cost.

Flashlights are often mishandled and subjected to abusive use by which they may be damaged or destroyed. For example, it is not unusual for a flashlight to be bumped or dropped, subjecting the components to impact and shock and often breaking the bulb, fracturing the casing, and damaging the batteries. In addition, flashlights are often used or stored in a moisture laden environment, and moisture which enters the casing may cause degradation and malfunctioning of the electrical components therein.

It has been common in recent years to provide flashlights with an adjustable focussing feature whereby the light beam may be adjusted from a flood beam to a spot beam. This feature requires some relative axial movement between the light bulb and a light reflector. While this is a very desirable feature, it does impose more stringent requirements on the overall construction and rigidity of the flashlight to permit repetitive refocussing of the light as desired, while, at the same time, maintaining the integrity and waterproof characteristic of the flashlight. Furthermore, many adjustable focussing assemblies used in the past have not properly collected the light emitted from the bulb and have wasted a good deal of that light.

Thus, a need exists for a rugged, heavy-duty flashlight which is versatile in use, resistant to shock and impact, waterproof, and varilably focussing. But it is imperative that a flashlight of this type be constructed in a way so that it is easily manufactured and assembled to minimize costs.

SUMMARY OF THE INVENTION

Accordingly, the primary object of this invention is to provide a novel flashlight having several unique features which afford the characteristics and advantages noted above.

A further object of this invention resides in the provision of a novel flashlight having an all plastic exterior casing and a transverse wall or platform integrally molded with the casing to separate a rearward battery compartment from a forward bulb compartment. The transverse wall protects both the bulb and the batteries from damaging impact and also serves as an internal base or shelf on which various components may be mounted.

Another object of the invention resides in the provision of the above-described flashlight wherein the plastic casing is reinforced by internal and external ribs, the internal ribs also serving to support batteries and prevent engagement of those batteries with the usual electrical contact strip extending substantially along the length of the compartment.

Still another object of the invention resides in the provision of the above novel flashlight which includes a novel bulb mounting assembly held in place by a retainer bushing which may be quickly connected and disconnected from the transverse wall, with both the bulb and the bushing being resiliently axially moveable with respect to the wall and the bulb socket so as to minimize the chance of damaging the bulb from impact or shock.

Still another object of the invention resides in the provision of the above novel flashlight wherein a reflector of novel design is moveable axially with respect to the bulb to adjustably focus the light from the bulb as a spot beam or a flood beam. The reflector includes a concave reflecting surface which combines a facetted parabolic surface on its outer larger diameter section and a plain, smooth spherical surface at its base to optimize the collection of light from the light bulb positioned centrally within the reflecting surface.

Still another object of the invention resides in the provision of the above novel flashlight which includes a novel waterproof head assembly in which a flange on the reflector, a lens, and an annular sealing gasket are retained in sealing engagement with a head cap or lens ring which threadedly engages on the open front end of the flashlight casing and seals against an O-ring mounted on the casing. The construction of the head assembly facilitates the overall assembly of the flashlight parts and thus reduces cost The head assembly is moveable axially on the casing to permit movement of the reflector relative to the bulb to refocus the light from a spot to a flood beam.

A further object of the invention resides in the provision of the above described novel flashlight which further includes a unique three-way switch assembly including a one-piece molded plastic actuator moveable between off, flashing, and on positions. The actuator has a pivotable pushbutton lever formed integrally therewith which is manually operated to intermittently open and close a switch arm and thereby cause flashing of the light bulb. The actuator is quickly and easily snapped into place on a switch housing formed on the exterior of the flashlight casing, this again facilitating assembly and reducing costs.

Other objects and advantages of the invention will become apparent from reading the following detailed description of the invention in which reference is made to the accompanying drawings.

BRIEF DESCRIPTION OF THE DRAWINGS

FIG. 8 is a front axial view of the flashlight casing, at about twice its actual size, taken along line 8—8 of FIG. 2A.

FIG. 9 is a fragmentary sectional view of the casing taken along line 9—9 of FIG. 2A.

FIG. 16 is a fragmentary side elevational section illustrating the bulb retainer at about twice its actual size.

FIG. 17 is an axial end view of the bulb retainer of FIG. 16.

DETAILED DESCRIPTION OF THE INVENTION

Figure 1:
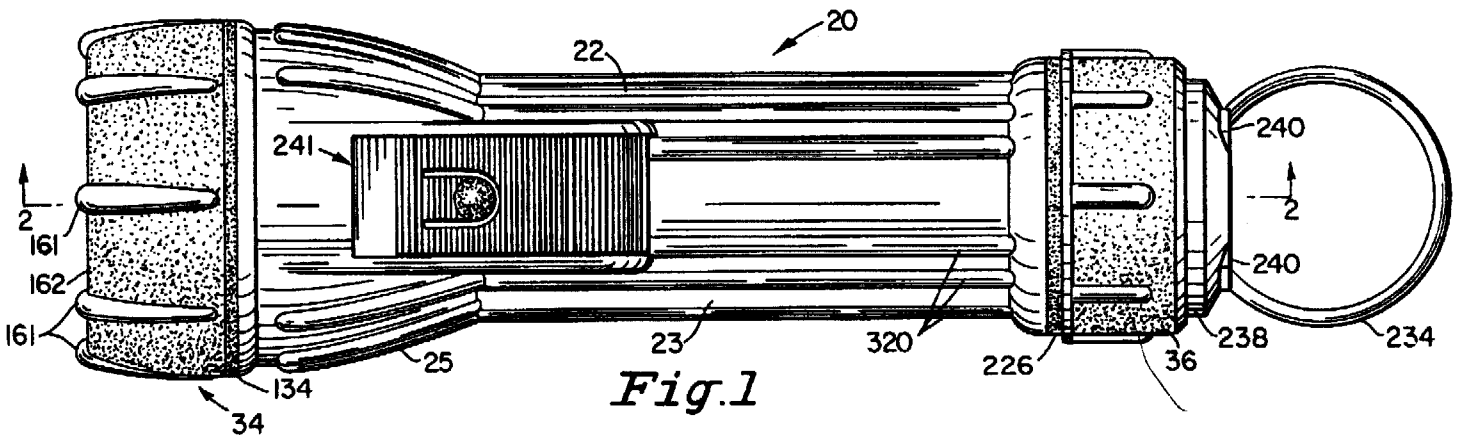
FIG. 1 is a top plan view of the novel flashlight of the invention, illustrated in approximate actual size.

Referring now to the drawings, the novel flashlight 20 of the invention includes a one-piece, rigid plastic, tubular casing 22 formed by a rearward cylindrical section 23 defining a compartment 24 containing for example, two or more D size batteries B1 and B2, and a forward enlarged tubular section 25 defining a bulb mounting compartment 26, the compartments being separated from each other by a transverse wall or platform 28 integrally molded to the circumferential wall of casing section 23. The forward end of section 25 and the rearward end of section 23 are threaded at 30 and 32 respectively, to receive a head cap assembly 34 and a rear end cap 36.

A small tubular socket 40 is integral with and extends forwardly from wall 28 within compartment 26 along the central axis of casing 22. Socket 40 has a central bore 422 provided with a plurality of resilient longitudinal ribs 44. An electrically conductive metallic eyelet 46 extends through an opening 48 in wall 28, and is crimped at opposite ends to provide a flange 50 for engagement by the positive terminal of battery B1 within compartment 24, and also a flange 52 at the bottom of bore 42 for engagement by an electrically conductive spring 54.

A standard flashlight bulb 56, e.g., a B 3½ type lamp, is mounted within bore 42 and includes a rear contact 58, a plug having an outer metal wall 60 formed with a plug flange 62, a lens 63, a filament 64 connected at one end to contact 58 and at its other end to a solder contact 66 on the outer wall 60.

Figure 2:
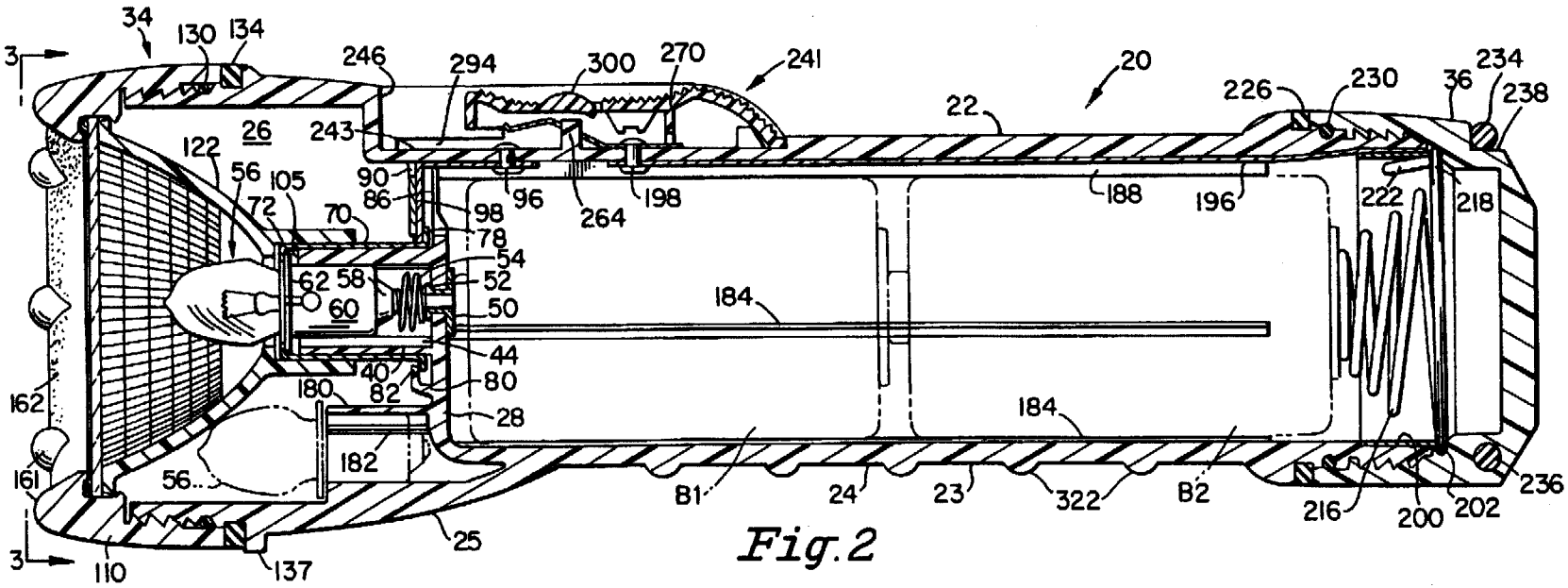
FIG. 2 is a sectional side elevational view of the flashlight taken along line 2—2 of FIG. 1.

Bulb 56 is loosely retained within socket 40 by an electrically conductive metal bushing 70 (FIGS. 2(*a*), 16 and 17), having at its front end an inwardly turned peripheral flange 72 defining a front opening 74 and at its rear end an outwardly turned flange section 76 provided with three equilaterally spaced radially extending lugs 78.

A small circular hub 80 (FIGS. 2, 2(*a*) and 8) is integral with and extends forwardly from wall 28 around socket 40 and includes at its front end three equilaterally spaced inwardly extending radial tabs 82 defining radial slots 84 therebetween. Tabs 82 are axially spaced from wall 28 to define an annular space 86 having an axial length exceeding the thickness of lugs 78 on bushing 70. As shown in FIGS. 2(*a*) and 8, panel 90 extends radially outwardly from a tab 82 and defines a slot 92 coextensive with and radially from space 86. A bent conductive contact strip 93 has an axial leg 94 fixed to casing 22 via contact rivet 96, and a radial leg 98 engaging against the inside face of panel 90.

As seen in FIGS. 8 and 9, wall 28 includes three angular slots 100 positioned axially behind tabs 82 and a radial slot 102 in axial alignment with panel 90 and strip 98. Wall 28 also includes a plurality of larger angular slots 104 positioned closely adjacent the wall of tubular section 23.

As shown in FIG. 2, bushing 70 slides over the outside diameter of socket 40, and as the bushing is pushed rearwardly, opening 74 clears lens 63 of bulb 56 and flange 72 engages against bulb flange 62 to push plug 60 rearwardly within socket 40 against the bias of spring 54.

When lugs 78 are aligned with slots 84, they will enter annular space 86 and the bushing may then be turned so that the lugs 78 align behind tabs 82. When bushing 70 is released, tabs 82 and lugs 78 cooperate to lock the bushing 70 and bulb 56 in place against the bias of spring 54 as shown in FIG. 2. In that locked position, one of the lugs 78 will engage against the leg 98 of the contact strip 93 to establish electrical contact from eyelet 46, spring 54, contact 58, filament 64, contact 66, wall 60, flange 62, flange 72, bushing 70, flange 76, and the lug 78 engaging strip 98 to contact 96.

As shown into FIG. 2, because the axial length of space 86 exceeds the thickness of lugs 78, there is axial clearance or end play of lugs 78 within space 86. Also, the axial length of socket 40 is such that an axial space 105 exists between the rear face of flange 62 and the end face 106 of socket 40. Consequently, bulb 56 is free to move axially and radially with respect to socket 40 and bushing flange 72, and both bulb 56 and bushing 70 are axially displaceable together against the force of spring 54 with respect to socket 40 and wall 28.

Figures 2A, 3:
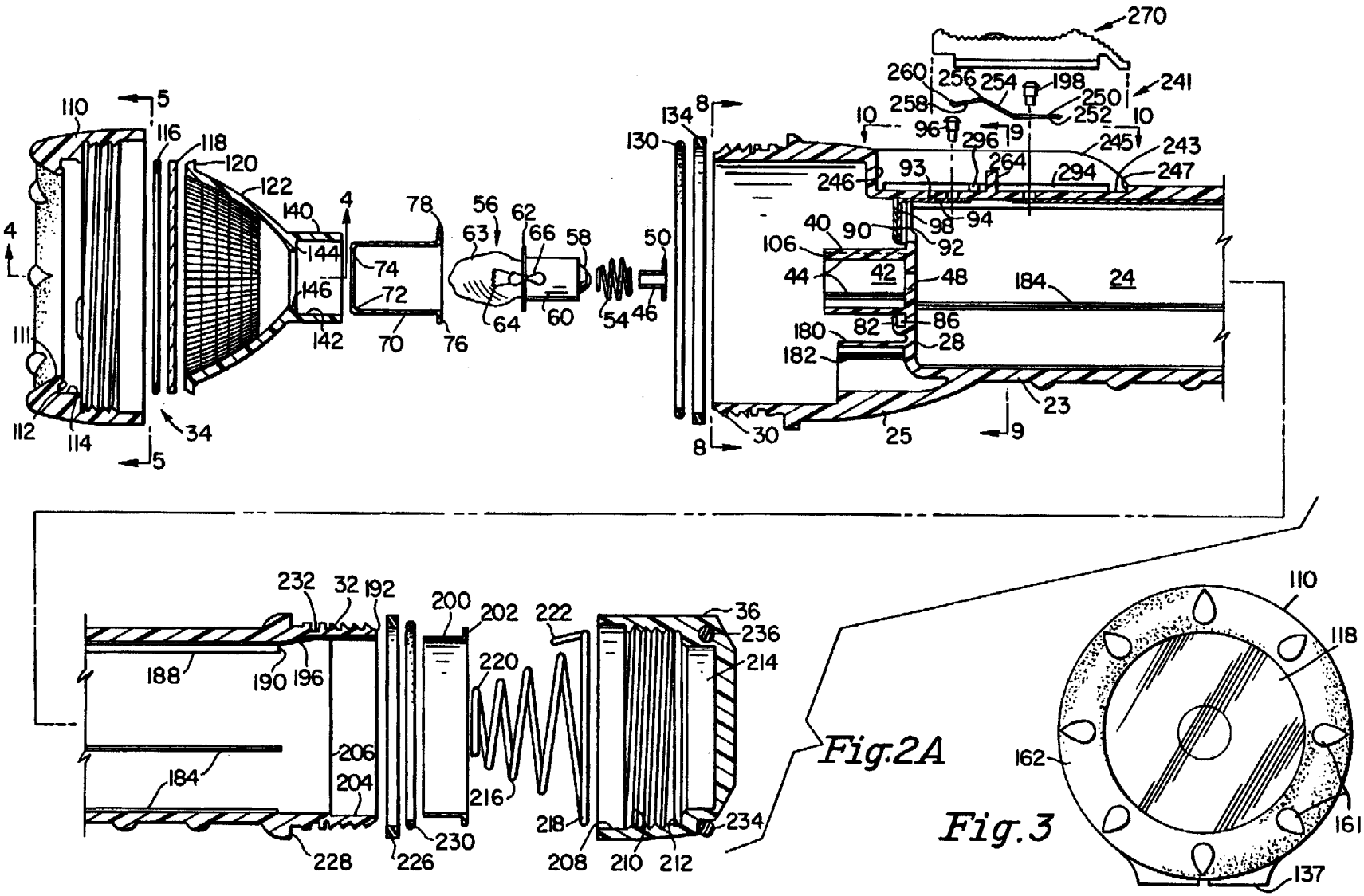
FIG. 2A is an exploded view of the various components of the flashlight illustrated in FIG. 2.
FIG. 3 is a front end view of the flashlight taken along line 3—3 of FIG. 2.
Figure 4:
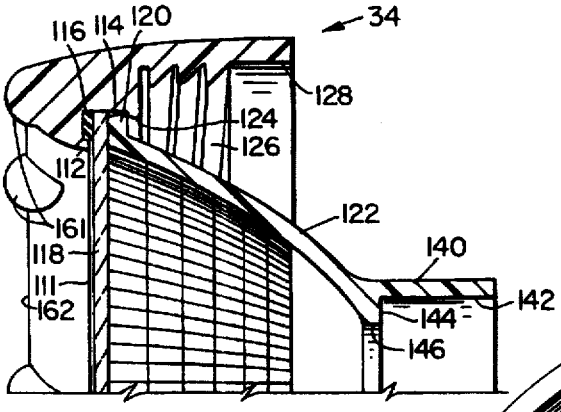
FIG. 4 is a fragmentary sectional view taken along line 4—4 of FIG. 2A, illustrating the head assembly at about twice its actual size.
Figure 5:
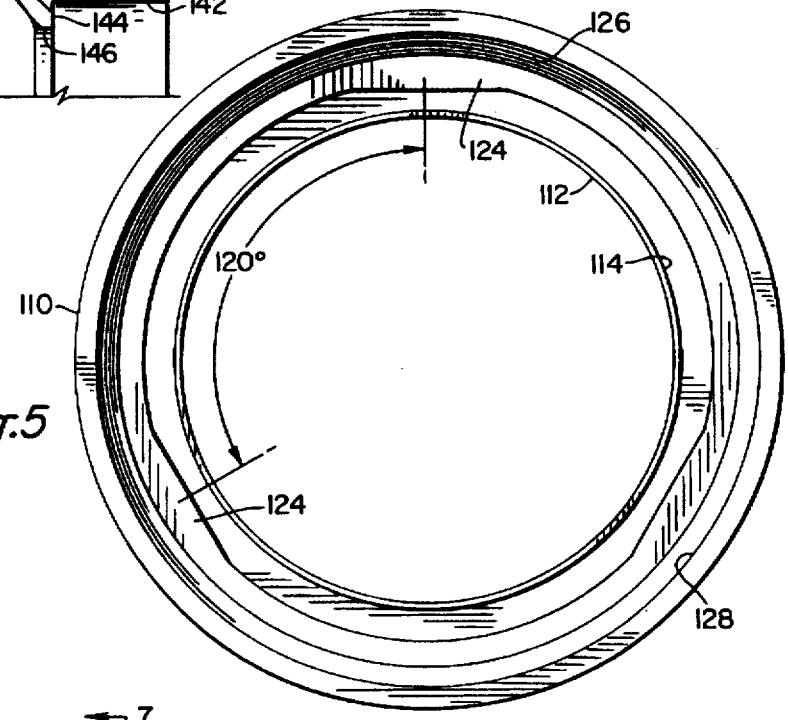
FIG. 5 is a rear axial view of the head cap or lens ring taken along line 5—5 of FIG. 2A, the lens ring being illustrated at about twice its actual size.
Figure 6:
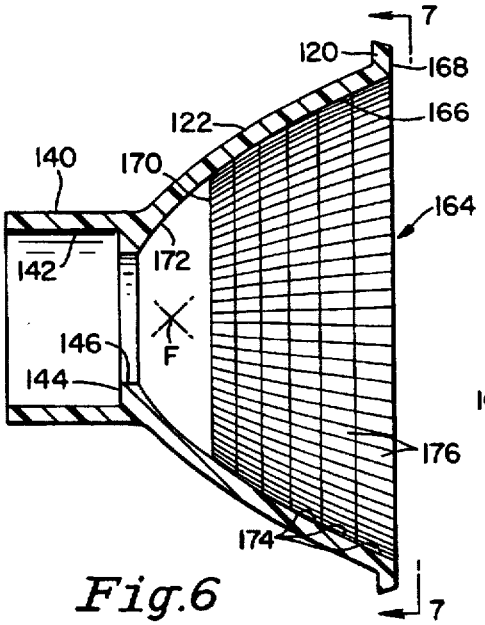
FIG. 6 is a fragmentary sectional view of the novel facetted reflector incorporated in the flashlight of the invention, illustrating the reflector at about twice its actual size.
Figure 7:
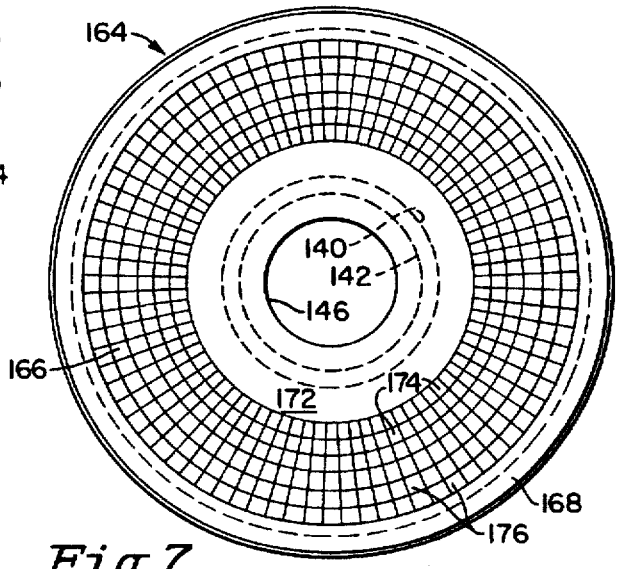
FIG. 7 is a front end view of the reflector taken along line 7—7 of FIG. 6.

Head assembly 34 (FIGS. 2, 2A and 4) includes a tubular plastic head cap or lens ring 110 having a front opening 111 defined by internal flange 112 which also forms together with the wall of ring 110 an enlarged gasket receiving counterbore 114. A Neoprene sealing gasket 116, a circular polycarbonate lens 118, and the outer peripheral flange 120 of a facetted polycarbonate reflector 122 fit within counterbore 114 and are retained therein by a plurality of thin flexible resilient tabs 124 which extend radially inwardly from counterbore 114 and engage behind the back edge of flange 120. Tabs 124 maintain the elements in tight sealing contact within counterbore 114 and prevent any water or other fluids from entering the head assembly through opening 111. Head cap 110 also includes an intermediate enlarged threaded bore section 126 and a larger straight end bore section 128.

Head assembly 34 is assembled on casing section 25 by rotating thread section 126 on threads 30 and an annular seal is provided between section 128 and section 25 by O-ring 130 which fits within annular groove 132. A cosmetic ring 134 is provided between the end face of ring 110 and annular flange 136 on section 25. The bottom of flange 136 is provided with a flat 137 on which the flashlight may rest without rolling.

Reflector 122 has a reduced diameter central hub section 140 having a bore 142 which slides over the outside diameter of bushing 170, the inner end of the bore being provided with a shoulder 144 and a central opening 146 through which the lens 63 of bulb 56 will extend for location within the concave reflective surface 164 of reflector 122. The innermost assembled position of head assembly 34 with respect to bulb 56 and bushing 70 is illustrated in FIG. 2 with shoulder 144 adjacent to but not abutting flange 72. Because of the novel way in which bulb 56 and bushing 70 are resiliently mounted relative to socket 40 and wall 28, the bulb is protected against breakage due to shock or impact caused by rough handling of the flashlight or by dropping the flashlight, for example on head assembly 34 or on tail cap 36. Should the flashlight be dropped, wall 28 prevents batteries B1 and B2 from slamming directly into bulb 56 or its mounting.

This novel bulb mounting arrangement is a significant feature of the invention. Not only does it simplify the assembly of bulb 56 in socket 40 through the quick connect-disconnect action of lugs 78 and tabs 82, but it also affords impact and shockproof protection for the bulb.

Cap 110 is also provided with a plurality of circumferentially spaced, axially extending ribs 160, which have nodules 161 that project over and beyond the front face 162 of cap 110. Thus, if the flashlight is stored in an upright position with nodules 161 resting on a support surface such as a storage shelf, table, etc., with the bulb 56 inadvertently left on, the light emitted from the bulb is readily visible at end face 162. A person may then turn the bulb off to prevent inadvertent premature discharge of the batteries B1 and B2 within compartment 24.

As mentioned hereinabove, another important feature of the invention is the adjustable focussing of the light from bulb 56 from a spot beam to a flood beam, and the novel design of reflector 122 enhances that focussing capability.

As shown in FIGS. 2, 2A, 4, 6 and 7, in reflector 122, the internal concave reflective surface 164 has a facetted parabolic surface section 166, which extends from the outer end face 168 of flange 120 to a point 170 at approximately two-thirds the depth of the reflector where it blends smoothly with a plain, smooth, spherical surface 172 at the inner end or base of the reflector.

In the assembly as illustrated in FIG. 2, the focal point F of the light from bulb 56, which is in the form of a cylindrical light source, is located within the region of spherical surface 172.

The facetted surface section 166 is formed by a plurality of concentric rows 174 of rectangular facets 176 extending axially inwardly to point 170 of the reflector. Each row includes eighty rectangular facets extending around the circumference of surface section 166, with the longer dimension of each facet extending in the axial direction. In each successive innermost row 174, the number of rectangular facets 176 remains the same at eighty, but the size of the facets 176 gets smaller because the diameter along the parabolic surface section 166 gets smaller. In practice, it is desirable that the smallest facets in the innermost row be as small as possible to optimize the collection of light from bulb 56, the size of course being limited by molding capabilities for the reflector.

We have found that the combination of the parabolic surface section 166 and the spherical surface 172, in combination with the generally cylindrical light source provided by bulb 56 concentrated at focal point F, minimize the light spillage from the bulb and maximize the amount of light collected by the facets 176 and concentrated in the light beam emitted from the flashlight. With the light source from bulb 56 basically being a cylindrical light source rather than the ideal or perfect pinpoint light source which does not exist in the real world, at the base of the reflector the light is distorted and dissipated in many different directions. Rather than extend the facetted parabolic surface section 166 all the way back to the base, it is better to form the base as a smooth plain spherical surface 172. The spherical surface smooths out the light which is emitted from all directions at the back end of the bulb 56 and smoothly blends that light with the concentrated beam produced by the facetted surface 166.

In the innermost position of lens ring 110 illustrated in FIG. 2, the light beam emitted from bulb 56 and reflector 122 will be in the form of a wider floodbeam. To refocus the light to a more concentrated narrow spotbeam, ring 110 is rotated axially outwardly from casing section 25 by a quarter to one half turn. The rotation of ring 110 away from casing section 25 moves reflector 122 axially outwardly with respect to bulb 56, which, however, is retained in place by bushing 70. Thus, the refocussing is accomplished without moving bulb 56.

Also provided in compartment 26 is a spare bulb socket 180 (FIGS. 2, 2A, and 8), integrally molded together with wall 28 and the outer wall of tubular section 25. Socket 180 is provided with a pair of axially extending resilient ribs 182 which frictionally engage against the plug of a spare bulb 184 to hold the bulb in place. Moreover, socket 180 is positioned and sized so that when the bulb 184 is mounted therein, the lens of the bulb is closely adjacent reflector 122. If the flashlight is dropped, reflector 122 aids in retaining the bulb within socket 180.

Returning now to the battery casing section 23 (FIGS. 1, 2, 2A, and 9), a plurality of battery support ribs 184, 186 and 188 extend longitudinally along the casing section to a location 190, spaced inwardly from the end face 192 of section 23. Ribs 186 and 188 form a channel 194 in which a conductive metal contact strip 196 extends from a contact rivet 198 to the rear of casing section 23 where it engages the outer diameter of a cylindrical conductive metal contact shell 200 having an outer end flange 202. The shell 200 fits snug within a counterbore 204 and abuts at its inner end against shoulder 206, which prevents axial inward movement of the shell. The inner face of flange 202 engages against end face 192 of section 23.

Rear end cap 36 (FIGS. 1, 2, 2A, and 15) includes a counterbore section 208, a threaded section 210 having a relief bore 212 at its base and an internal smaller diametered counterbore 214. A tapered conductive contact spring 216 has its large diameter end 218 fitting within relief bore 212 and its small diameter end 220 engaging against the negative terminal of battery B2. Large end 218 has a tab 222 bent inwardly so that good electrical contact is made between shell 200, flange 202, end 218 and tab 222 as illustrated in FIG. 2.

Note particularly in FIG. 2 that the outer wall of batteries B1 and B2 engage against ribs 184, 186, and 188 to avoid any contact with strip 196. Note also that the rear end and negative terminal of battery B2 is spaced inwardly from shell 200 under the bias of spring 216 and that shell 200 is prevented from moving axially inwardly into engagement with battery B2 by shoulder 206 and flange 202. This configuration of parts prevents any short circuiting between strip 196, shell 204, and batteries B1 or B2.

As shown in FIGS. 2 and 2(*a*), when the end cap is in place a cosmetic ring 226 is located between a flange 228 on section 23 and the inner end face of cap 36 and an O-ring 230 positioned in groove 232 on section 23, provides a waterproof seal between end cap 36 and the battery casing section 23.

A ring hanger 234 is pivotally connected to a lug section 236 and the ring fits within a reduced diameter turned section 238 adjacent the back end of cap 36. The end face of the cap is provided with three equilaterally spaced flats 240, on which the flashlight may be supported in an upright position.

Figure 10:
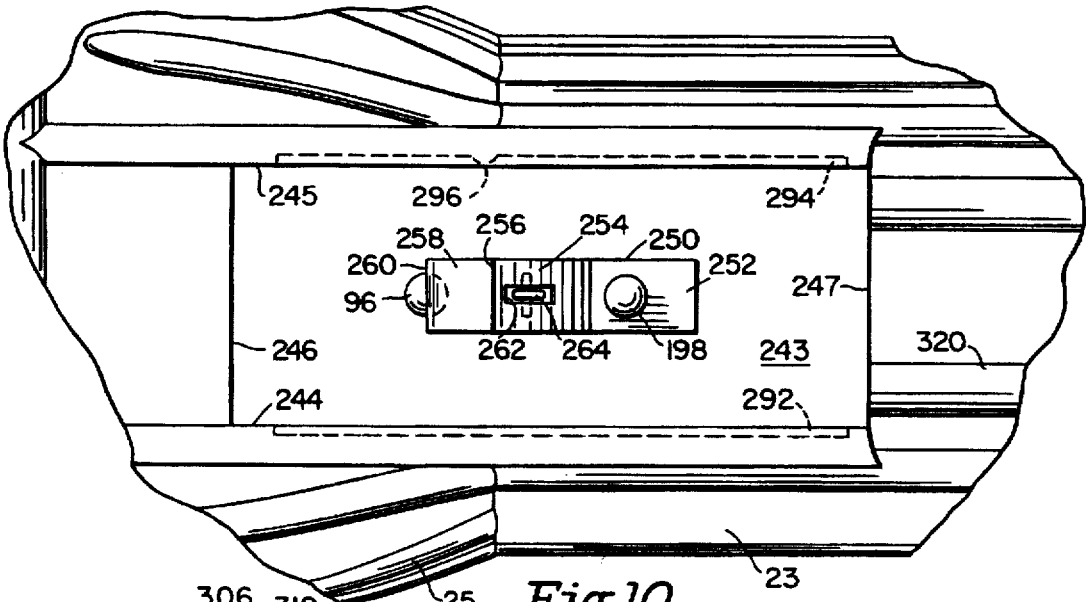
FIG. 10 is a fragmentary plan view taken along line 10—10 of FIG. 2A, illustrating the switch mounting housing on the outer wall of the casing.
Figure 11:
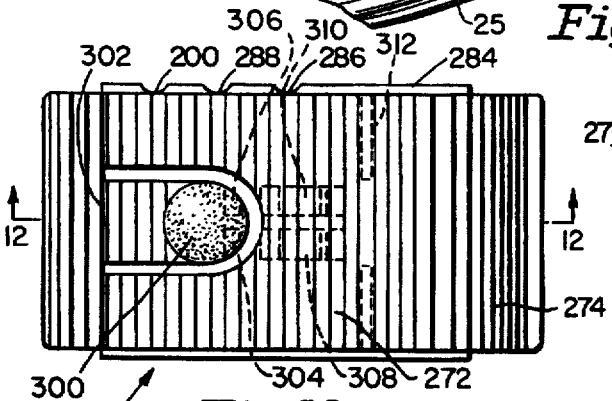
FIG. 11 is a top plan view of the novel, one-piece, plastic switch actuator at about twice its actual size.
Figure 12:
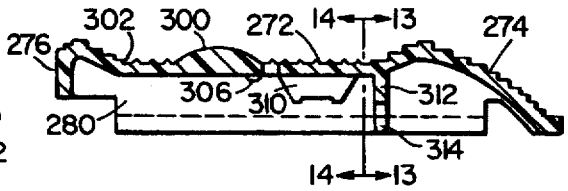
FIG. 12 is a fragmentary sectional view taken along line 12—12 of FIG. 11.
Figure 13:
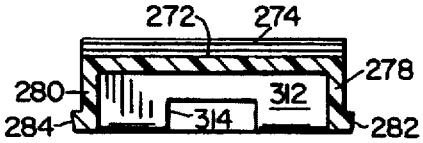
FIG. 13 is a fragmentary sectional view taken along line 13—13 of FIG. 12.
Figure 14:
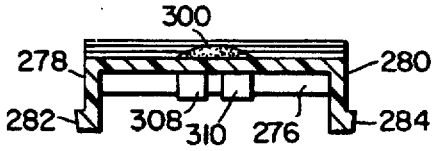
FIG. 14 is a fragmentary sectional view taken along line 14—14 of FIG. 12,.
Figure 15:
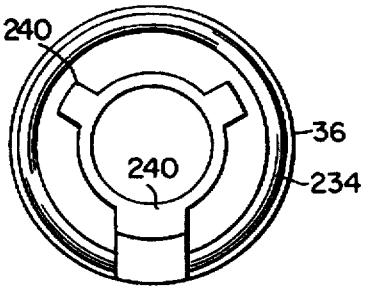
FIG. 15 is an end view of the rear end cap taken along line 15—15 of FIG. 2.

Electrical contact is made between contactors 96 and 198 by a switch assembly 241, which includes a bent spring contact strip 250. The strip has a flat 252 which is fixed to contact 198, an upwardly inclined section 254 bending at 256 into a downwardly inclined section 258 which terminates into a flat terminal end 260 which, in the off position, is spaced away from contact 96. Bend 256 acts as a cam surface. A small longitudinal slot 262 is formed in section 254 (FIG. 10).

As part of switch assembly 241, a switch housing 242 (FIGS. 2, 2A, 9 and 10) is formed on the outer wall of casing 22 and includes a flat bottom wall 243, upright vertical walls 244 and 245, a front vertical wall 246, and a short rear vertical wall 247. Contacts 96 and 198 extend through and are fixed to bottom wall 243.

A one piece, plastic, three-way actuator 270 (FIGS. 11–14) is slidably mounted on bottom wall 243, for longitudinal back and forth movement between "off", "flashing", and "on" positions. Actuator 270 is a hollow, box type structure which includes a configured top wall 272 curved downwardly at the rear 274 for ease of finger engagement, a downwardly depending front wall 276 and downwardly depending sidewalls 278 and 280. Formed at the bottom of walls 278 and 280 are laterally projecting side rails 282 and 284, with rail 284 having three notches 286, 288, and 290 formed therein in correspondence with the "on", "flashing", and "off" positions, respectively, of actuator 270.

Side walls 244 and 245 of housing 242 are provided with opposed longitudinal slots 292 and 294, respectively, adjacent bottom wall 243 to loosely receive rails 282 and 284 therein and to permit longitudinal sliding movement of actuator 270 back and forth. Actuator 270 is resilient enough so that rails 282 and 284 are easily and quickly snapped in and out of slots 292 and 294 to facilitate and thereby reduce the cost of assembly. A protruding nodule 296 is formed in slot 294 and selectively engages in notches or indents 286, 288, or 290 to establish the "on", "flashing", or "off" position of switch 270. Vertical walls 246 and 247 captivate actuator 270 longitudinally within housing 242.

Top wall 272 at its forward end is provided with a U-shaped cut out pushbutton lever 300 pivotally connected to the top wall by a living hinge 302. A pair of small downwardly depending laterally spaced lugs 304 and 306 are formed on the underside of pushbutton 300. To the rear of pushbutton 300 a pair of laterally spaced cams 308 and 310 project downwardly from top wall 272. Behind the cams, a transverse wall 312 extends between side walls 278 and 280 to reinforce the actuator, with wall 312 provided with a central bottom opening cut out 314 having a width exceeding the width of contact strip 250.

A stop or post 264 projects upwardly outwardly from bottom wall 243 and fits within slot 262 without interfering with the vertical opening and closing action on strip 250.

As already mentioned, actuator 270 is quickly and easily snapped into place within switch housing 242 by merely pressing side rails 282 and 284 into slots 292 and 294, respectively. With the actuator 270 in its rearmost "off" position with nodule 296 located in indent 290, contact strip 250 is in its open position with edge 260 out of engagement with contact 96 as illustrated in FIG. 2. In this position, pushbutton 300 directly overlies stop 264 which prevents the button 300 from being depressed into engagement with the cam surface 256 of strip 250. In this position, the flashlight is off.

To place the flashlight in a flashing condition, actuator 270 is moved forwardly to its intermediate position in which the nodule 296 engages within notch 288 so that pushbutton 300 no longer overlies stop 264. When the pushbutton is now depressed, it engages against cam surface 256 to make contact between edge 260 and contact 296. Repeated depression and release of pushbutton 300 will thereby cause a flashing of bulb 56. The lateral spacing between lugs 304 and 306 permit longitudinal movement of pushbutton 300 past stop 264.

When the flashlight is to be placed in a continuous "on" condition, switch 270 is pushed forward until nodule 296 engages within notch 286 in which position the cams 308 and 310 will engage against cam surface 256, pressing strip 250 down to cause edge 260 to engage and stay in contact with contact 96. Again, the lateral space between cams 308 and 310 accommodates stop 264 as the switch is placed in its forwardmost "on" position.

A plurality of ribs 320 extend longitudinally along the outside surface of casing 22 and a plurality of ribs 322 extend partly circumferentially around the bottom of casing section 23. The ribs 320 and 322 provide a non-slip grip while handling the flashlight. In addition, those ribs and the internal ribs 184, 186, and 188 reinforce casing 122.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

We claim:

1. A flashlight comprising a plastic tubular casing having a rearward battery compartment adapted to receive a battery means and a forward bulb compartment, a transverse wall integrally molded with said casing and separating said battery and bulb compartments, a tubular socket integrally molded with said wall and extending forwardly therefrom within said bulb compartment, a light bulb having a plug portion mounted within said socket, contact means extending through said wall for electrically connecting said bulb to a battery means in said battery compartment, said contact means having a first contact located within said socket adjacent said wall, a contact spring electrically connecting said bulb to said first contact and permitting resilient axial movement of said bulb relative to said socket, switch means mounted on said casing for selectively supplying battery current to said bulb, retainer means for holding said bulb within said socket against the bias of said contact spring and being axially movable with respect to said wall and said socket, whereby said bulb and said retainer means are resiliently mounted with respect to each other and with respect to said socket and said wall, cooperating means on said retainer means and said wall for permitting quick connection and disconnection of said retainer means from said wall, said cooperating means including a plurality of angularly spaced lugs on said retainer means and a plurality of angularly spaced tabs connected to and spaced axially forwardly of said wall and defining an annular space therewith, whereby said lugs are aligned with spaces between said tabs to enter said annular space and said retaining means is turned to align said lugs with said tabs preventing said retaining means from moving axially away from said socket.

2. The flashlight defined in claim 1, comprising a reflector mounted within said bulb compartment and having a concave reflective surface adjacent to and focussing the light from said light bulb, said reflective surface having a large diameter outer end and a small diameter inner end and including a parabolic facetted section extending axially inwardly from said outer end to a point intermediate said outer and inner ends and a smooth spherical section extending from said intermediate point to said inner end.

3. The flashlight defined in claim 2, said facetted section including a plurality of concentric rows of rectangular facets, the number of facets in each row being the same but decreasing in size as the diameter of the facetted section decreases.

4. The flashlight defined in claim 3, each of said rectangular facets having its large dimension extending along an axis of said surface.

5. The flashlight defined in claim 2, said reflector and said light bulb being moveable axially relative to each other to adjustably focus the light from said light bulb.

6. The flashlight defined in claim 5, said reflector being axially movably mounted from said casing for axial adjustment relative to said light bulb.

7. The flashlight defined in claim 2, comprising a head assembly which includes a tubular head cap, an annular gasket, a lens, and said reflector which has an annular flange at its large outer end, said tubular head cap having a front end opening and an annular groove surrounding said front end opening, said gasket, said lens, and said annular flange of said reflector fitting within said annular groove, said head cap having resilient radially inwardly extending retainer means adjacent an inner end of said groove for permitting said flange to be snapped into said groove, the inwardly extending retainer means engaging behind said flange to hold said gasket, said lens, and said flange in sealing engagement with said head cap.

8. The flashlight defined in claim 7, said inwardly extending retainer means including a plurality of angularly spaced resilient tabs.

9. The flashlight defined in claim 8, said cap being axially adjustably mounted on a front end of said casing and an O-ring providing a seal between the cap and the casing.

10. The flashlight defined in claim 9, said cap having a plurality of angularly spaced nodules extending beyond its front face so that when the flashlight is supported on said nodules, light is visible from the front face if the flashlight is on.

11. The flashlight defined in claim 1, said casing having a rearward tubular section defining said battery compartment with an open rearward end and a rear end cap removably connected on said rearward end, a plurality of ribs formed internally on said rearward section and extending longitudinally therealong for supporting batteries in radially spaced relation from said tubular section.

12. The flashlight defined in claim 11, wherein two of said ribs define a longitudinally extending channel, a contact strip located within said channel and extending from said switch means to the rearward end of said rearward tubular section, a cylindrical contact shell mounted at the rearward end of said rearward tubular section in connection with said contact strip, a contact spring mounted within said rear end cap for electrically connecting said contact shell with a terminal of a rearmost battery of said battery means within the battery compartment.

13. The flashlight defined in claim 12, said casing comprising means for preventing said shell from moving axially forwardly in said rearward tubular section into engagement with a rearmost battery.

14. The flashlight defined in claim 1, said switch means comprising a switch housing formed on an exterior of said tubular casing, a first terminal connected to said bulb and a second terminal adapted to be connected to the battery means, a contact arm fixed to one of said first and second terminals and moveable into and out of engagement with an other of said terminals, a one piece plastic three-way switch actuator movably mounted in said switch housing between off, flashing, and on positions, said actuator including an integrally formed pivotal lever which, when said actuator is in said flashing position, may be manually moved down and up to engage and disengage said contact arm from said other terminal to cause flashing of said light bulb.

15. The flashlight defined in claim 14, said actuator including cam means for holding said contact arm in engagement with said other terminal when said actuator is in the on position.

16. The flashlight defined in claim 15, said switch housing including a bottom wall and a pair of laterally spaced side walls, said side walls and said actuator together having cooperating guide means permitting longitudinal sliding movement of said actuator along said bottom wall.

17. The flashlight defined in claim 16, said cooperating guide means including opposed longitudinal slots on said side walls and laterally extending rails on said actuator which snap into said slots.

18. The flashlight defined in claim 17, comprising second cooperating means on said housing and said actuator to establish the off, flashing, and on positions of said actuator.

19. The flashlight defined in claim 18, said second cooperating means including longitudinally spaced indents on one of said rails and a nodule in a corresponding slot which selectively engages in an appropriate indent as said actuator is moved longitudinally within said housing.

20. The flashlight defined in claim 18, a stop projecting outwardly from said bottom wall which, when said actuator is in the off position, underlies said pivotal lever to prevent said lever from depressing said contact arm.

21. The flashlight defined in claim 16, a stop projecting outwardly from said bottom wall which, when said actuator is in the off position, underlies said pivotal lever to prevent said lever from depressing said contact arm.

22. A flashlight comprising a plastic tubular casing having a rearward battery compartment adapted to receive battery means and a forward bulb compartment, a transverse wall integrally molded with said casing and separating said battery and bulb compartments, a tubular socket integrally molded with said wall and extending forwardly therefrom within said bulb compartment, a light bulb having a lens, a plug mounted within said socket, and a flange on said plug adjacent said lens, contact means extending through said wall for electrically connecting said bulb to a battery means in said battery compartment, switch means mounted on said casing for selectively supplying battery current to said bulb, said contact means having a first contact located within said socket on said wall, a contact spring electrically connecting said plug to said first contact and permitting resilient axial movement of said bulb relative to said socket, a tubular retainer bushing having an inwardly turned flange on its outer end and a plurality of angularly spaced outwardly directed radial tabs of a given thickness on its inner end, said retainer bushing being axially displaceable around said socket toward said wall so that said inwardly turned flange abuts against said plug flange to hold said plug within said socket against the bias of said contact spring, a plurality of angularly spaced inwardly directed tabs connected to and spaced axially forwardly of said wall and defining therewith an annular space having a given axial width, the axial width of said annular space being greater than the thickness of said lugs, whereby said lugs are aligned with spaces between said tabs to enter said annular space and said bushing is turned to align said lugs with said tabs preventing said bushing from moving axially away from said socket, said bulb and said bushing being thereby resiliently mounted with respect to each other and with respect to said socket and said wall.

23. The flashlight defined in claim 22, an electrical contact strip positioned adjacent one of said tabs for engaging one of said lugs, said strip being connected to said switch means.

24. A flashlight comprising a tubular casing having a rearward battery compartment adapted to receive a battery means and a forward bulb compartment, a tubular socket mounted within said bulb compartment, support means connecting said socket to said casing, contact means located within said socket on said supporting means and adapted to be electrically connected to battery means mounted in said battery compartment, a light bulb having a plug portion mounted within said socket, a contact spring electrically connecting said bulb to said contact means and permitting resilient axial movement of said bulb relative to said socket, retainer means for holding said bulb within said socket against the bias of said contact spring and being axially movable with respect to said supporting means and said socket, whereby said bulb and said retainer means are resiliently mounted with respect to each other and with respect to said socket, switch means mounted on said casing for supplying battery current to said bulb, cooperating means on said retainer means and said support means for permitting quick connection and disconnection of said retainer means from said support means, said cooperating means including a plurality of angularly spaced lugs on said retainer means and a plurality of angularly spaced tabs connected to and spaced axially forwardly of said support means and defining an annular space therewith, whereby said lugs are aligned with spaces between said tabs to enter said annular space and said retaining means is turned to align said lugs with said tabs preventing said retaining means from moving axially away from said socket.

25. The flashlight defined in claim 24, comprising a reflector mounted within said bulb compartment and having a concave reflective surface adjacent to and focussing the light from said light bulb, said reflective surface having a large diameter outer end and a small diameter inner end and including a parabolic facetted section extending axially inwardly from said outer end to a point intermediate said outer and inner ends and a smooth spherical section extending from said intermediate point to said inner end.

26. The flashlight defined in claim 25, said facetted section including a plurality of concentric rows of rectangular facets, the number of facets in each row being the same but decreasing in size as the diameter of the facetted section decreases.

27. The flashlight defined in claim 26, each of said rectangular facets having its large dimension extending along an axis of said surface.

28. The flashlight defined in claim 25, said reflector and said light bulb being moveable axially relative to each other to adjustably focus the light from said light bulb.

29. The flashlight defined in claim 28, said reflector being axially movably mounted from said casing for axial adjustment relative to said light bulb.

30. The flashlight defined in claim 25, comprising a head assembly which includes a tubular head cap, an annular gasket, a lens, and said reflector which has an annular flange at its large outer end, said tubular head cap having a front end opening and an annular groove surrounding said front end opening, said gasket, said lens, and said annular flange of said reflector fitting within said annular groove, said head cap having resilient radially inwardly extending retainer means adjacent an inner end of said groove for permitting said flange to be snapped into said groove, the inwardly extending retainer means engaging behind said flange to hold said gasket, said lens, and said flange in sealing engagement with said head cap.

31. The flashlight defined in claim 30, said inwardly extending retainer means including a plurality of angularly spaced resilient tabs.

32. The flashlight defined in claim 30, said cap being axially adjustably mounted on a front end of said casing and an O-ring providing a seal between the cap and the casing.

33. The flashlight defined in claim 30, said cap having a plurality of angularly spaced nodules extending beyond its front face so that when the flashlight is supported on said nodules, light is visible from the front face if the flashlight is on.

34. A flashlight comprising a tubular casing having a rearward battery compartment adapted to receive a battery means and a forward bulb compartment, a tubular socket mounted within said bulb compartment, support means connecting said socket to said casing, a light bulb having a lens, a plug mounted within said socket, and a flange on said plug adjacent said lens, contact means located within said socket on said supporting means and adapted to be electrically connected to battery means mounted in said battery compartment, a contact spring electrically connecting said plug to said contact means and permitting resilient axial movement of said bulb relative to said socket, retainer means for holding said bulb within said socket against the bias of said contact spring and being axially movable with respect to said supporting means and said socket, whereby said bulb and said retainer means are resiliently mounted with respect to each other and with respect to said socket, switch means mounted on said casing for supplying battery current to said bulb, said retainer means comprising a tubular retainer bushing having an inwardly turned flange on its outer end and a plurality of angularly spaced outwardly directed radial tabs of a given thickness on its inner end, said retainer bushing being axially inwardly displaceable around said socket so that said inwardly turned flange abuts against said plug flange to hold said plug within said socket against the bias of said contact spring, a plurality of angularly spaced inwardly directed tabs connected to and spaced axially forwardly of said support means and defining therewith an annular space having a given axial width, the axial width of said annular space being greater than the thickness of said lugs, whereby said lugs are aligned with spaces between said tabs to enter said annular space and said bushing is turned to align said lugs with said tabs preventing said bushing from moving axially away from said socket, said bulb and said bushing being thereby resiliently mounted with respect to each other and with respect to said socket and said support means.

35. The flashlight defined in claim 34, an electrical contact strip positioned adjacent one of said tabs for engaging one of said lugs, said strip being connected to said switch means.

* * * * *